United States Patent [19]

Daussin et al.

[11] 4,375,022

[45] Feb. 22, 1983

[54] CIRCUIT BREAKER FITTED WITH A DEVICE FOR INDICATING A SHORT CIRCUIT

[75] Inventors: Bernard Daussin, Mesnil St Laurent; Jean Hennemann, Homblieres, both of France

[73] Assignee: Alsthom-Unelec, Paris, France

[21] Appl. No.: 131,720

[22] Filed: Mar. 19, 1980

[30] Foreign Application Priority Data

Mar. 23, 1979 [FR] France ..... 79 07398

[51] Int. Cl.[3] ..... H01H 33/26; H01H 33/54

[52] U.S. Cl. ..... 200/148 R; 200/144 R; 200/308

[58] Field of Search ..... 200/148 R, 308, 310, 200/144 R

[56] References Cited

U.S. PATENT DOCUMENTS

| | | | |
|---|---|---|---|
| 2,925,484 | 2/1960 | Thommen | 200/148 R |
| 2,981,817 | 4/1961 | Frentzel | 200/144 B |
| 3,605,047 | 9/1971 | Kasahara | 335/1 |
| 3,852,556 | 12/1974 | Kane et al. | 200/310 |
| 4,016,521 | 4/1977 | Seybold | 337/241 |

FOREIGN PATENT DOCUMENTS

| | | |
|---|---|---|
| 2505158 | 5/1976 | Fed. Rep. of Germany . |
| 589276 | 6/1947 | United Kingdom . |

*Primary Examiner*—Robert S. Macon

*Attorney, Agent, or Firm*—Sughrue, Mion, Zinn, Macpeak and Seas

[57] ABSTRACT

A circuit breaker or cut out provided with a short-circuit indicating device and comprising, for each pole, separable contacts disposed inside a breaking chamber in which an electric arc develops when the contacts become separated. The said short-circuit indicating device is actuated by the gas pressure waves generated by the electric arc in the breaking chambers.

9 Claims, 5 Drawing Figures

FIG. 1
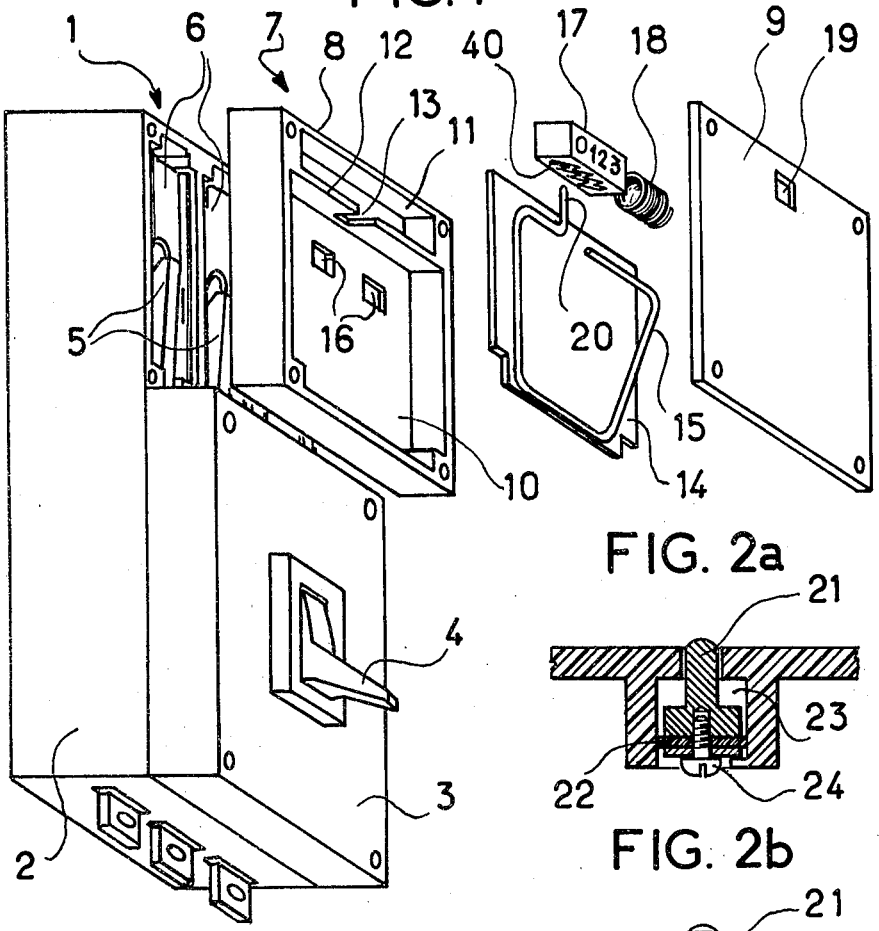
FIG. 2a
FIG. 2b
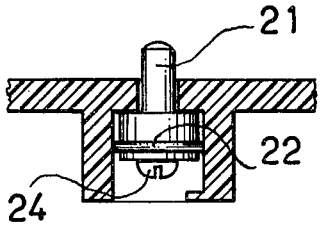
FIG. 3a
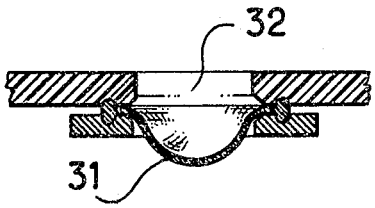
FIG. 3b
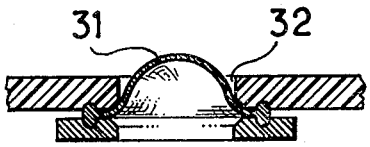

CIRCUIT BREAKER FITTED WITH A DEVICE FOR INDICATING A SHORT CIRCUIT

The invention relates to circuit breakers of the type having their contacts in the air, i.e. not immersed in any special circuit breaking fluid such as oil or $SF_6$ gas. The invention relates more particularly to the means of providing a device to indicate that such an air-type circuit breaker has broken a short-circuit current.

BACKGROUND

Circuit breakers and cut-outs are already known which have what is known as a short-circuit indicator. This is the case particularly with cut-outs having magneto-thermal trips provided with a device indicating the magnetic or thermal mode of operation of the trip. Such a device is described for example in French Pat. No. 1 401 630.

For the user it is indeed of interest to know whether the tripping of the circuit breaker is a result of magnetic or thermal operation. But in many cases indication of the magnetic functioning of the trip will be inadequate as a means of judging whether there is an actual short-circuit or simply an abnormally high over-current. Furthermore, the structural elements of such an indicator are directly linked with those of the trip, which considerably limits the possibilities of construction.

The progress at which the present invention aims resides in providing circuit breakers with a short-circuit indicator, the functioning of which is linked not to the tripping of the protective devices but to the power developed in the breaking chambers of the apparatus and more precisely the wave of gas pressure which results therefrom.

Air-type circuit breakers intended to break short-circuited currents generally comprise a fixed contact and a moving contact per pole disposed inside a relatively closed breaking chamber. In the event of over-voltage, under the action of protective trips or the direct effect of electro-dynamic stresses generated by the current, the contacts open and an electric breaking arc appears, the voltage of which depends upon the structural characteristics of the breaking chamber and the current intensity. The higher the current intensity, the greater will be the power of the electric breaking arc. The effect of the power of the arc gives rise to a gas pressure wave in the breaking chamber resulting from the sudden rise in temperature and possibly from the emission of gases through the walls of the breaking chamber. The amplitude of this pressure wave is linked to the power of the breaking arc and thus to the intensity of the current actually broken by the apparatus. For low levels of current, the pressure will be small and in contrast for high currents such as those which may result from a short-circuit the pressure may attain levels sufficient to actuate a pressure-sensitive indicating device.

BRIEF SUMMARY OF THE INVENTION

The present invention provides an air-type circuit breaker provided with a device for indicating the existence of a short-circuit and comprising, for each circuit-breaking pole, separable contacts disposed inside a breaking chamber in which an electric arc develops upon separation of the contacts, wherein the said short-circuit indicating device is actuated by the gas pressure wave created by an electric arc in the breaking chambers.

Preferably, the short-circuit indicating device comprises a movable member subject both to a stress developed by the gas pressure wave and to an opposing stress, the said movable member passing from a first "no pressure" position to a second "pressurized" position when the stress developed by the gas pressure wave is greater than the opposing stress.

BRIEF DESCRIPTION OF THE DRAWINGS

Embodiments of the invention are described by way of example with reference to the accompanying drawing, in which:

FIG. 1 is an exploded perspective view of a circuit breaker provided with a short-circuit indicating device in accordance with the invention; and FIGS. *2a, 2b* and *3a, 3b* are sectional views of other embodiments of short-circuit indicating devices in accordance with the invention.

DESCRIPTION OF PREFERRED EMBODIMENTS

FIG. 1 shows a three-pole low voltage air-type circuit breaker which is provided with a short-circuit indicator in accordance with the invention. The circuit breaker 1 comprises a moulded casing 2 closed by a cover 3 through which passes an operating lever 4. Inside the casing 2 are mounted the various components of the circuit breaker, comprising in particular an operating mechanism for opening and closing the contacts, a three- pole excess current trip with separable contacts 5 disposed inside a breaking chamber 6 for each pole. Fixed on the circuit breaker casing 2 is a short-circuit indicator 7 operated by the gas pressure generated in either of the breaking chambers 6 when a short-circuited current is broken.

The short-circuit indicator 7 comprises a casing 8 closed by a cover 9, the whole assembly being mounted on the circuit breaker casing and closing off the breaking chambers 6. The casing 8 comprises two housing chambers 10 and 11 separated by a partition 12 in which there is a slot 13. A movable flap 14 is applied to the bottom of the housing 10 by a spring clip 15 compressed between the flap 14 and the cover 9. The flap 14 occludes apertures 16 provided in the bottom of the casing 8 opposite each of the breakage chambers 6.

A visual indicator 17 subject to the thrust of a spring 18 is mounted to slide in the housing 11. The front face of the indicator 17 carries reference markings visible through a window 19 in the cover 9. The lateral face of the indicator 17 includes a slot 40 of sawtooth shape, each of the teeth corresponding to a reference marking on the front face. The end 20 of the spring 15 is engaged through the slot 13 in the partition 12 in the sawtooth slot 40 of the indicator 17.

The manner in which the device operates will now be explained, the fact being taken into account that initially the end 20 of the spring 15 is engaged in the sawtooth slot in the indicator 17 opposite the reference marking 0 which appears in the window 19 of the cover 9.

Installed in an electric power distributing circuit, the circuit-breaker will operate automatically in the event of the current intensity exceeding the operating threshold of the excess current trip. The contacts 5 open and an electric arc appears in the breaking chambers 6. The gas pressure generated in the breaking chambers 6 is applied to the flap 14 through windows 16. If this pressure is sufficient to overcome the opposing stress applied to the flap 14 by the spring 15, that is to say if the current intensity is very high, corresponding to a short-circuit, the flap 14 rises and the end 20 of the spring 15 passes over the first sawtooth of the indicator 17 which advances by one notch, propelled by the spring 18.

After the current has been broken by the circuit breaker, the pressure returns to its normal level, the flap 14 and the end 20 of the spring 15 return to their initial position while the reference marking 1 of the indicator 17 appears in the window 19 of the cover 9. The user is thus warned that the circuit breaker has broken a short-circuited current and he will be able to check the condition of the installation before putting it into operation again. If a fresh short-circuit should occur, the device will operate again in the same way and the reference marking 2 of the indicator 17 will then appear in the window 19 of the cover 9. In the same way, the reference marking 3 will appear in the event of the circuit breaker breaking a short-circuited current a third time. The user is then warned that the circuit breaker may need to be replaced or be overhauled or serviced in accordance with the manufacturer's instructions. Of course, the force of the spring 15 and the disposition and dimensions of the apertures 16 will be determined by the manufacturer according to the specifications of the circuit breaker on which the indicating device has to be installed, so that the indicating device operates only with effect from a specific level of current which is matched to the rated current and circuit breaking capacity of the apparatus.

In the present description, the flap 14 and the spring 15 are common for all three breaking chambers of the apparatus, but it is quite obvious that it is equally well possible to use one flap and one return spring for each of the breaking chambers, the movement of any of the flaps operating a common indicating device.

Many alternative forms of embodiment are obviously possible with a combination of various types of movable elements which become displaced under the effect of pressure with different models of indicating devices operated by such displacement.

Thus, FIGS. 2*a*, 2*b*, and 3*a*, 3*b* show simple forms of embodiment which are particularly suitable for closed circuit breakers in moulded casings in which the pressure wave generated in the breaking chambers is propagated through the entire casing. In these embodiments the movable member, moving under the effect of the pressure, likewise serves as an indicating device, moving from a first stable "no pressure" position to a second stable position after passage of the pressure wave and it is necessary to reset the indicating device after each short-circuit.

In FIGS. 2*a* and 2*b*, the device is constituted by an indicator piston 21 fitted with a sealing washer 22 consisting for example of an elastomer, sliding in a cylinder 23. Under the effect of the pressure inside the casing, the indicating piston 21 moves from the position shown in FIG. 2*a* to the position shown in FIG. 2*b*. The stress opposing the force exerted by the pressure inside the casing is provided by the friction of the sealing washer 22 against the cylinder 23, friction which can be adjusted by tightening or slackening a screw 24. This same frictional force prevents the return of the piston 22 from the position in FIG. 2*b* to the position in FIG. 2*a* unless the user has pressed the indicator piston 21 to return it to its initial position.

In FIGS. 3*a* and 3*b*, the indicating device is constituted by a bistable capsule 31 of generally hemispherical form fixed in front of an aperture 32 in the cover of the apparatus. Under the effect of the internal pressure resulting from breaking of a short-circuit current, the capsule 31 changes from the position shown in FIG. 3*a* to the position shown in FIG. 3*b*. The stress opposing the force exerted by the pressure inside the casing is provided by internal tension in the material of which the capsule consists and may be suitably obtained by judicious choice of the thickness and elasticity of the material from which the capsule is made. Similarly, the internal tension in the material of the capsule prevents return from the position shown in FIG. 3*b* to the position shown in FIG. 3*a* until the user has pressed on the capsule 31 to restore it to its original position.

Although FIGS. 2*a*, 2*b* and 3*a*, 3*b* do not demonstrate the fact, it is possible to associate with the indicators 21 or 31 a totalising device which is operated step by step at each displacement of the piston 21 or the capsule 31 in one direction. Such a totalising counter may in *per se* known manner consist for example of a ratchet wheel, a rack with a catch or any similar device.

Thus, the user is not only warned every time a short-circuited current is broken but he is in a position to know how many short-circuits the circuit breaker has already handled.

Of course, without departing from the scope of the invention, it is possible to provide further alternative indicating devices other than those described hereinabove which are given purely by way of example. In particular the indicating device could be combined other devices actuated by it and fulfilling other associated functions such as the prevention of reclosure of the circuit breaker or the causing of contacts to close to produce a remote signal either at each short-circuit or after a given number of short-circuits.

We claim:

1. In an air-type circuit breaker provided with a device for indicating the existence of a short-circuit and comprising, for each circuit-breaking pole, separable contacts disposed inside a breaking chamber in which an electric arc develops upon separation of the contacts, the improvement wherein said short-circuit indicating device comprises means separate from said contacts and specifically responsive to a gas pressure wave created by said electric arc developed in the breaking chamber at a current level constituting a short-circuit condition of the circuit-breaker as contrasted to an abnormally high over-current, and wherein said short-circuit indicating device comprises a movable member subject both to a stress developd by the gas pressure wave and to an opposing stress, and wherein said movable member comprises a member passable from a first stable "no pressure" position to a second stable "pressurized" position when the stress developed by the gas pressure wave is greater than the opposing stress, means for maintaining said movable member in the "pressurized" position after disappearance of the gas pressure wave, means for restoring it to the "no pressure" position by an intentional resetting action, and wherein said circuit-breaker comprises a closed casing, a pressure wave generated in the breaking chamber being propagated through the entire casing and wherein said short-circuit indicating device comprises a cylinder internally of the circuit breaker casing and integral therewith, an opening within the casing coaxial with said cylinder, a piston mounted within said cylinder and slidable therein and a sealing washer borne by said piston and in frictional engagement with the interior of the cylinder, an indicating element carried by said piston and projectable through said opening within the casing wall, said sealing washer being of a material and being sized to the diameter of the cylinder such that said indicator piston moves from said first position to said second position responsive to a gas pressure wave of predetermined value corresponding to a short circuit condition, and wherein said indicator piston is manually displaceable from said second position to said first position, constitutes said member passable from said first position to said second position, and said sealing washer constitutes said means for maintaining the movable member in the "pressurized" position after disappearance of the gas pressure wave.

2. In an air-type circuit breaker provided with a device for indicating the existence of a short-circuit and comprising, for each circuit-breaking pole, separable contacts disposed inside a breaking chamber in which an electric arc develops upon separation of the contacts, the improvement wherein said short-circuit indicating device comprises means responsive to a gas pressure wave created by said electric arc developed in the breaking chamber at a current level constituting a short-circuit condition of the circuit-breaker as contrasted to an abnormally high over-current, and wherein said short-circuit indicating device includes a totalising element which is actuated step by step.

3. A circuit breaker according to claim 2, further comprising means for actuating the totalising element step by step by said movable member which is subject to the stress developed by the gas pressure wave.

4. A circuit breaker according to claim 3, wherein the totalising element further comprises means for preventing reclosure of the circuit breaker after a specific number of operations.

5. A circuit breaker according to claim 1, wherein said movable member includes means for preventing reclosure of the circuit breaker when it is in the "pressurized" position.

6. In an air-type circuit breaker provided with a device for indicating the existence of a short-circuit and comprising, for each circut-breaking pole, separable contacts disposed inside a breaking chamber in which an electric arc develops upon separation of the contacts, the improvement wherein said short-circuit indicating device comprises means responsive to a gas pressure wave created by said electric arc developed in the breaking chamber at a current level constituting a short-circuit condition of the circuit-breaker as contrasted to an abnormally high over-current, said short-circuit indicating device comprising a movable member subject both to a stress developed by the gas pressure wave and to an opposing stress, and wherein said movable member comprises a member passable from a first "no pressure" position to a second "pressurized" position when the stress developed by the gas pressure wave is greater than the opposing stress, said air-type circuit breaker further comprising a casing, said short-circuit indicating device comprising a casing mounted to the short-circuit breaker casing and closing off said breaking chamber, said short-circuit indicating device casing including an opening communicating the interior of the indicating device casing to the breaking chamber, said movable member comprising a flap positioned within said indicating device casing and overlying the opening communicating the interior of the indicating device casing to the breaking chamber, and wherein a spring clip biases said flap against the indicating device casing wall to close off said opening, and wherein said indicating device further comprises shiftable means operatively coupled to said flap and shiftable in response to movement away from said opening from said first position to said second position when the current level creates a gas pressure wave by the electric arc developed in the breaking chamber reaches a short-circuit condition.

7. The circuit breaker as claimed in claim 6, wherein said shiftable indicator comprises a bar-shaped totalizing element bearing indicia on one face thereof, said bar-shaped totalizing element includes a saw-toothed slot with the saw-teeth corresponding to said indicia, and wherein said spring clip comprises a terminal end engaged in said slot, and means for spring biasing said indicator in a direction parallel to said notch such that during repeated circuit breaker conditions, the end of the spring clip passes over the saw-tooth notches to advance notch by notch propelled by the biasing spring.

8. The circuit breaker as claimed in claim 7, wherein partition means separates the interior of said indicating device casing into a first chamber housing said flap and a second chamber housing said totalizing element, said partition means and a wall of the casing guiding movement of said bar-shaped totalizing element, and wherein said partition means includes a narrow slot through which one end of the spring clip projects to engage the saw-toothed slot of the totalizing element, and wherein said spring means biasing said totalizing element comprises a compression coil spring abutting one end of the bar-shaped totalizing element and biasing the bar-shaped element axially at right angles to the tip of the spring clip which engages the totalizing element by way of said saw-toothed slot.

9. In an air-type circuit breaker provided with a device for indicating the existence of a short-circuit and comprising, for each circuit-breaking pole, separable contacts disposed inside a breaking chamber in which an electric arc develops upon separation of the contacts, the improvement wherein said short-circuit indicating device comprises means responsive to a gas pressure wave created by said electric arc developed in the breaking chamber at a current level constituting a short-circuit condition of the circuit-breaker as contrasted to an abnormally high over-current, said short-circuit indicating device comprising a movable member subjected both to a stress developed by the gas pressure wave and to an opposing stress, and wherein said movable member comprises a member passable from a first "no pressure" position to a second "pressurized" position when the stress developd by the gas pressure wave is greater than the opposing stress, means for maintaining said movable member in the "pressurized" position after disappearance of the gas pressure wave, and means for restoring it to the "no pressure" position by an interntional resetting action, and wherein said circuit breaker comprises a closed casing, the pressure wave generated in the breaking chamber being propagated through the entire casing, and wherein said short-circuit indicating device comprises a hole within said circuit breaker casing, a bistable capsule of spherical form being fixedly mounted in overlying position with respect to said hole so as to be bistably movable between a first position where it projects spherically away from the opening and interiorly of the circuit breaker casing, and a second position where it protrudes through said opening such that upon the occurrence of a short-circuit condition, the pressure wave displaces the bistable capsule from retracted to projected position, and wherein the presence of said hole within said casing permits manual shift of the bistable capsule from projected to retracted position to reset the short-circuit indicating device, said bistable capsule comprises said movable member.

* * * * *